US005803725A

United States Patent [19]

Horn et al.

[11] Patent Number: 5,803,725

[45] Date of Patent: Sep. 8, 1998

[54] TRIPLE-MIX SURFACE-MIX BURNER

[76] Inventors: Wallace E. Horn; William A. Horn, both of 1988 Herbert Ave., Hellertown, Pa. 18055-1739

[21] Appl. No.: 874,510

[22] Filed: Jun. 13, 1997

[51] Int. Cl.[6] ..... F23C 7/00

[52] U.S. Cl. ..... 431/187; 239/424; 239/416.4; 239/416.5

[58] Field of Search ..... 239/424, 416.4, 239/416.5; 431/187

[56] References Cited

U.S. PATENT DOCUMENTS

| | | | |
|---|---|---|---|
| 2,095,065 | 10/1937 | Hays . | |
| 3,685,740 | 8/1972 | Shepherd | 239/424 |
| 3,814,327 | 6/1974 | Dada | 239/424 |
| 4,531,960 | 7/1985 | Desprez . | |
| 5,112,219 | 5/1992 | Hiemstra . | |

*Primary Examiner*—Carroll B. Dority
*Attorney, Agent, or Firm*—Gregory J. Gore

[57] ABSTRACT

A surface burner which combusts a gas and oxygen mixture uses a tri-laminar delivery of the oxygen and fuel gas to the burner face with individual control over the flow of each gas. The structure of the laminar flow at the burner face includes an oxygen jet at the center, a surrounding fuel gas jet, and a third jet means for the delivery of an oxygen flow which surrounds the flow of the other gases. Each of the three flows is individually adjustable so that the most efficient combination of combustion gases is selected to achieve the desired resultant flame characteristics. The body of the burner is cooled by a circumferential oxygen delivery chamber which is bounded by the inside surface of the outer wall of the burner body. The internal structure of the burner includes separate gas delivery chambers constructed by using stacked chamber-separated plates spaced apart and positioned within the cylindrical burner body. Individual tubing carries the gases between the individual chambers and the burner face.

19 Claims, 4 Drawing Sheets

TRIPLE-MIX SURFACE-MIX BURNER

FIELD OF THE INVENTION

This invention relates to non-liquid gas burners for producing a flame for industrial use. More specifically, it relates to the types of gas burners used in the glass and quartz-working industry.

BACKGROUND OF THE INVENTION AND DESCRIPTION OF PRIOR ART

Gas-type burners (non-liquid fuel) are widely used in the industrial arts for producing a very hot flame to melt and work materials, such as glass and quartz. Specifically, the burners can be bench top-mounted and have an adjustable body which is tiltable on a horizontal axis to a desired fixed position. Other types of burners include hand torches, lathe burners, and ribbon burners. All of these burners include a face plate where jets of gas exit the burner at the base of the flame. The workpiece is moved through or positioned in the flame so that it can be heated to a desired amount at a given location.

There are various qualities of industrial burner flames which are desired; that is, heat, velocity, stability and flame dynamics. The ability of the flame to burn at very high temperatures is extremely important, especially when working harder glasses or quartz which are more difficult to melt. It is also desired to have a flame which has stability. A stable flame will not be subjected to ambient drafts which can distort the shape of the flame if it is too "soft". Another characteristic of the "soft" flame is an overly rich fuel-to-oxygen mixture which can blacken, stain or contaminate a workpiece. Most often, a very sharp, tight flame created by a lean fuel mixture is desired. A stable flame should also be controllable; that is, the burner should have adjustability so that the size, length and shape of the flame can be varied. The ability to have a needle-sharp flame from ½-long and increasable to as much as 36-inches long is ideal. A smaller, sharp flame is required to do very small diameter or pinpoint heating required by more delicate work. Other desirable flame dynamics include the absence of cold spots in the flame. These can be caused by improper fuel mixing which results in unburnt fuel. Thrust is another important flame characteristic and permits a burner to produce a long flame of high velocity which is both sharp and hot. Being able to vary the length of the flame while maintaining its temperature and stability is important because it keeps the burner cooler-running and permits the workpiece to be held a greater distance from the burner, allowing greater freedom of movement of the workpiece.

One solution to providing a flame with the qualities of stability, velocity and high temperature has been the selection of fuel. Burners operate on a combination of oxygen and a second "fuel gas". Hydrogen, propane and natural gas are the three most commonly used fuels. Hydrogen can provide the hottest temperature, but it is both dangerous and expensive. Propane is the least expensive, however, the burner usually does not operate with the same efficiency and it is the "dirtiest" fuel. Hence, the flame is susceptible to carbon buildup on the workpiece from unburnt fuel. Natural gas is usually chosen as a cost compromise between hydrogen and propane in that it is extremely clean-burning and priced between the two other fuels. Unfortunately, the flame burns with the least amount of heat, compared to hydrogen and propane.

The desired working flame may also be achieved by selecting the type of burner used. Two common types of industrial gas burners are premix and surface-mix. Premix burners generally display a very hard focused flame, however, they have disadvantages in that their flames are noisy and susceptible to dangerous flashbacks because the fuel mixes inside the burner body (generally called the "torch"). A premix burner flame which is very hot and intense without sufficient flame velocity will create heat around the face of the burner. A close workpiece with intense heat can cause the flame to travel back to the face of the burner and possibly destroy it. Noise is also a serious problem that can, over time, cause injury to the hearing of personnel in the area. Furthermore, you need different size heads to change the size of a flame on a premix burner.

Surface-mix burners, on the other hand, are quieter and safer than premix burners because there is no mixing of the fuels inside the burner. Instead, outside the burner, separate gas jets diffuse together and mix in the atmosphere just above the surface of the burner where they combust (hence, the name "surface-mix"). Unfortunately, most surface-mix burners do not have good flame velocity and usually operate inefficiently and very fuel rich. Their higher fuel consumption makes them expensive to operate. Surface-mix burners produce flames which are generally softer, weaker flames. They are not very stable or as hot as premix burners.

A problem which affects all burners is keeping the torch body and burner face cool. A glass or quartz workpiece can often be ruined by an overheated deteriorating burner face which contaminates the workpiece by spitting burner face particles onto the surface of the workpiece. A workpiece can also be ruined by carbon particles produced by an inefficient-burning flame.

The most pertinent prior art patent of which the applicants are aware is U.S. Pat. No. 5,112,219 issued to Hiemstra on May 12, 1992 which discloses a device that produces a flame from a dual-gas-mixing industrial burner. This reference discloses a surface-mix burner head with three coaxial gas jets emanating from the face of the burner. The centermost jet is a tube which supplies oxygen. The next outermost coaxial jet is the fuel gas jet, preferably hydrogen. Those jets are surrounded by a third, outermost coaxial jet which, like the innermost jet, also feeds oxygen into the flame. The outer jet provides additional oxygen that prevents the loss of volatile hydrogen by surrounding it. The oxygen jets are fed by chambers which run off the same pressure of a single oxygen port. Hiemstra teaches the use of triple coaxial jets with a volatile fuel, such as hydrogen only. There is no mention that it would be suitable with propane as the fuel gas or that the oxygen jets be individually regulated.

There is therefore a need in the art to provide a safe, quiet-running industrial burner which is adjustable from a soft flame to a very stable, tight long flame with the ability to create flames of varying dynamics in the range between these extremes. There is a further need in the art to provide an industrial flame with these characteristics that is versatile, efficient, cool-running and which provides very high heat transfer. There is also a need for higher flame temperatures which can melt harder glass and quartz materials. Finally, there is a need in the art to provide an industrial flame with all of the qualities mentioned above, but which can run on less expensive and less dangerous fuels, such as propane.

SUMMARY OF THE INVENTION

The present invention seeks to meet the needs in the art described above by creating a surface-mix burner which produces intense heat, yet runs quietly and cool on a safe and inexpensive fuel gas, such as propane. This is accomplished by surrounding a coaxial fuel/oxygen jet with a separately regulated supply of oxygen. It is critical that the surrounding oxygen be highly controlled, but it may be delivered in different ways: it may be provided as a third coaxial jet, similar to the Hiemster device; it can be provided in non-coaxially shaped ports which exit from the face of the burner around the fuel/oxygen jets; or, it may be delivered to the face of the burner from separate discreet jet orifices. In any case, it is important that all three sources of combustion gases which are fed to the burner face be individually controlled. In the present invention, this is accomplished by way of a manifold with needle valves that control the supply of gas to three separate ports on the body of the burner. According to the particular construction of the burner body which will be further described herein, these ports supply three separate chambers which lead through individual conduits to the burner face.

Being able to separately regulate the flow of oxygen, both in the center of and surrounding the fuel gas jets, provides the ability to create a variable flame from a surface-mix burner which has excellent heat, velocity and combustion efficiency. This is the main discovery of the present invention which has never been tried before. More importantly, it has been discovered that these flame qualities may also be obtained with the use of an inexpensive and safe gas, like propane. It is a further discovery that by using the particular construction of the torch body further described herein, the burner can be internally self-cooling which in turn preheats the surround-oxygen supply. This may contribute to the combustion efficiency of the present invention. As a further advantage, more complete combustion is achieved which avoids the problems of cold spots or carbon buildup. The present invention is not limited to only one type of oxidizer. It will operate on pure oxygen or air to produce maximum temperatures and maximum efficiency. Oxygen is recommended to produce the hottest flame.

It is therefore an object of the present invention to create an efficient and safe industrial burner which is capable of delivering high heat with an inexpensive fuel, such as propane. It is a further object of the present invention to provide an industrial burner which is more efficient, clean running and displays no carbon buildup when using dirty fuels, like propane, so that the burner ports do not become clogged or the workpiece becomes contaminated. It is yet a further object of the invention to create a burner which runs extremely quiet, yet provides a very high heat transfer. It is another object of the present invention to provide an industrial burner with the ability to utilize fuel gas more efficiently, while producing an extremely intense high heat flame with a wide range of versatility and flame characteristics to work harder, larger diameter, glass and quartz workpieces. These and other advantages will become obvious to those skilled in the art from the following drawings and description of the preferred embodiment.

DESCRIPTION OF THE PREFERRED EMBODIMENT

Figure 1:
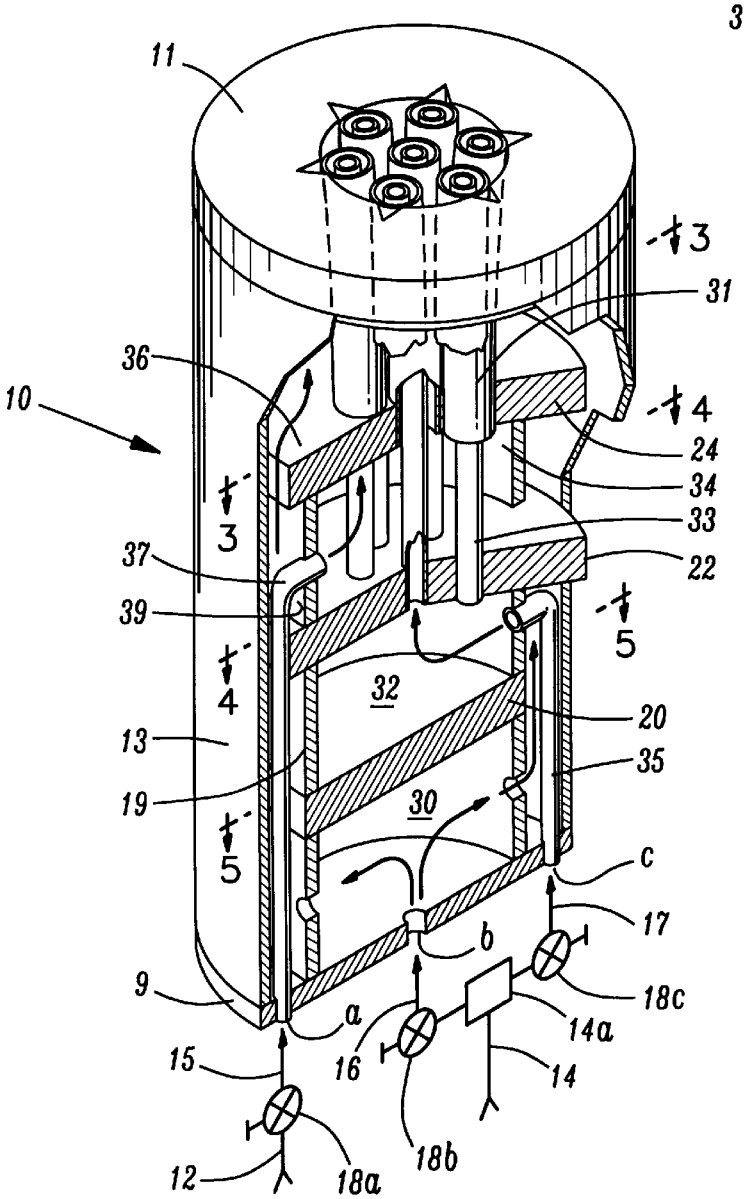
FIG. 1 is a top left isometric cutaway view of the gas burner of the present invention.

Referring now to FIG. 1, one embodiment of the gas burner 10 of the present invention is shown. This and the other embodiments are depicted without the usual support stand and clamp structures which are all well-known in art and form no part of the present invention. Also, the particular fuel and oxygen supply lines with the necessary valving are not depicted, but shown diagrammatically. The burner includes a thin-walled cylindrical body 13 with a face plate 11 at the top and a base plate 9 at the bottom. A fuel gas and oxygen enter the burner through entrance ports a, b and c in the base plate 9. As diagrammatically shown in this figure, the fuel gas supply 12 is regulated by valve means 18*a* to provide a regulated stream of gas 15 into conduit 37. The oxygen supply 14 is first fed into a manifold 14*a* where it is divided into two streams, each separately regulated by valve means 18*b* and 18*c*. These streams provide individually regulated flows of the oxygen gas 16 and 17 into entrance ports b and c in base plate 9. One of the oxygen supplies 17 is fed into conduit 35 through ports c. The other stream of oxygen supply 16 is fed through port b in the center of the base which directly leads to a first chamber 30 at the bottom of the burner.

Located directly above the first chamber 30, there are two additional chambers, each bounded top and bottom by separator disks 20, 22, and 24 as shown in FIG. 1. The chambers are stacked vertically and are circumferentially bounded laterally by individual cylindrical rings 19 which define the lateral walls of each chamber. Each of the chambers individually feeds an opening in the face of the burner which will be shown in greater particularity with regard to FIG. 2. In this embodiment, the outer body 11 of the burner and the inside surface of the burner face form the chamber walls of the uppermost chamber, however, an additional ported ring (not shown) similar to the other chamber side wall rings may be added between the burner face 11 and disk 36 for additional structural support. A jacket 39 is formed by the space between the chamber rings and the inside surface of the outer body of the burner defines a conduit for one of the oxygen streams.

The flow of each gas stream through the burner will now be described. Referring first to fuel gas 15, it enters a port at the base and passes through conduit 37 shown at the left side of FIG. 1. Conduit 37 is a tube which travels up the side of the burner body through a vertically-extending jacket and then passes through the side of the ring which forms the lateral wall of chamber 34, the third chamber from the bottom. This chamber may also be fed from a tube which passes directly up through base plate 9 and disk 20 as in the embodiment shown in FIG. 6. Chamber 34 is in exclusive fluid communication with a large sunburst-shaped port 40 in the burner face. In a similar fashion, a separately regulated supply of oxygen 17 enters through conduit 35 on the right side of the burner body as shown in this figure which leads to chamber 32, the second chamber from the bottom. The second chamber is in fluid communication with the surface of the burner through a second group of delivery tubes 33 being internal to and concentric with tubes 31 which carry the fuel gas. Both groups of tubes are splayed radially outward in the upward direction.

Figure 3:
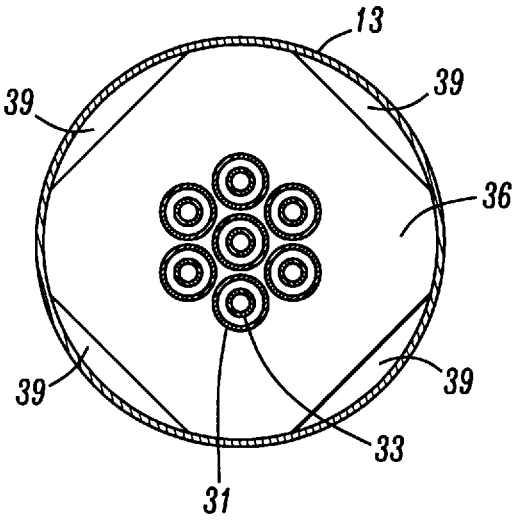
FIG. 3 is a top plan sectional view taken from FIG. 1 as shown in that figure.

A separately regulated supply of oxygen 16 enters through a port in the center of the base of the burner body into a first chamber 30 which includes radially disposed ports in a ring which forms the sides of its outer walls. These ports are in fluid communication with the jacket formed by a space between the outer wall of the various chamber rings and the burner body. This stream of oxygen thus flows around the outside of the other chambers and is in direct fluid communication with the inner surface of the torch body wall. This supply of oxygen makes its way up past the other chambers to an uppermost chamber 36. As shown in FIG. 3, passage for oxygen along the sides of disk 36 through jacket 39 is provided by removal of material around the circumference of a circular disk which in all other areas directly abuts the inner wall of the body 13.

Thus, as shown in FIG. 1, two individually regulated streams of oxygen and one stream of a fuel gas are independently fed through individual conduits to the burner face where they mix and combust. The gases are delivered to the burner face as laminar, concentric streams of gas in an oxygen/fuel/oxygen layered configuration.

Figure 2:
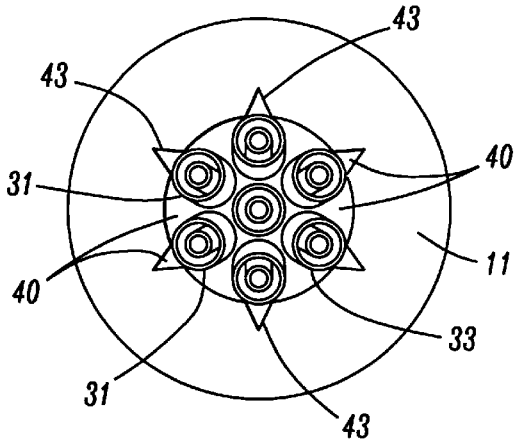
FIG. 2 is a top plan view of the embodiment shown in FIG. 1.

Referring now to FIG. 2, the location of ports in the burner face 11 are more clearly shown. Tubes 31 are shown clustered around the circumference of circular aperture 40 which further include triangular notches 43 around its circumference in the area adjacent to the tubes. Concentric with and within tubes 31 are positioned tubes 33. Therefore, the three streams of gas are delivered to the burner face through seven coaxial delivery tubes surrounded by a large open port. The centermost flow is an oxygen jet, then surrounded by the concentric fuel gas port, which is in turn surrounded by a large open area 40 that also surrounds all other ports supplying a second flow of oxygen to the burner face.

Figure 4:
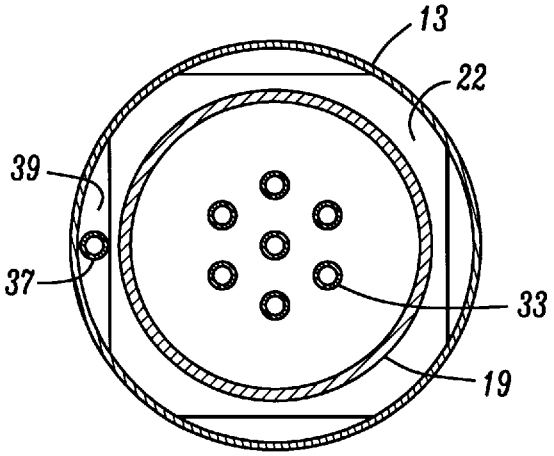
FIG. 4 is a top plan sectional view taken from FIG. 1 as shown in that figure.
Figure 5:
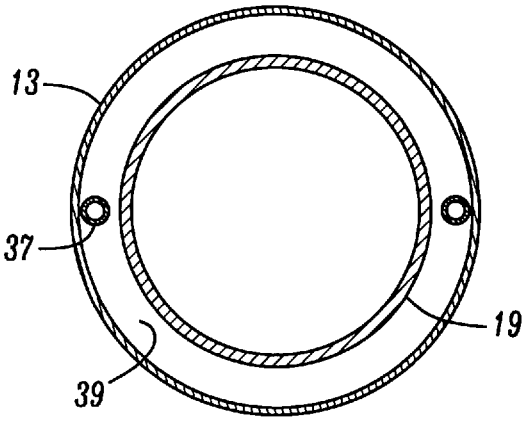
FIG. 5 is a top plan sectional view taken from FIG. 1 as shown in that figure.

FIGS. 3, 4 and 5 more clearly show the position of tube 37 within the jacket 39 and the configuration of disks 36 and 22. Chamber 34 is bounded from above by disk 24 and at the bottom by disk 22. This chamber is sealed, except for delivery tubes 31 which extend upward through disk 24. These tubes continue upward to the top of the burner in the center of face 11 so that fuel gas entering this chamber passes through tubes 31 for mixing with oxygen gas as it exits the face of the burner.

Figure 7:
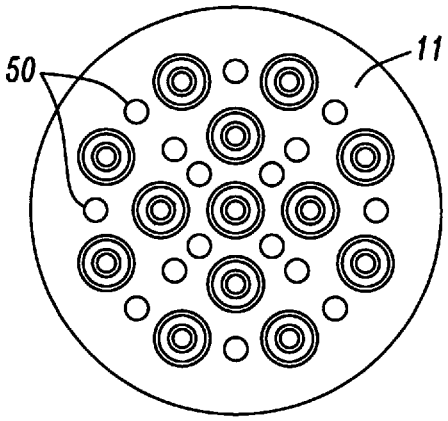
FIG. 7 is a top plan view of the embodiment shown in FIG. 6.
Figure 6:
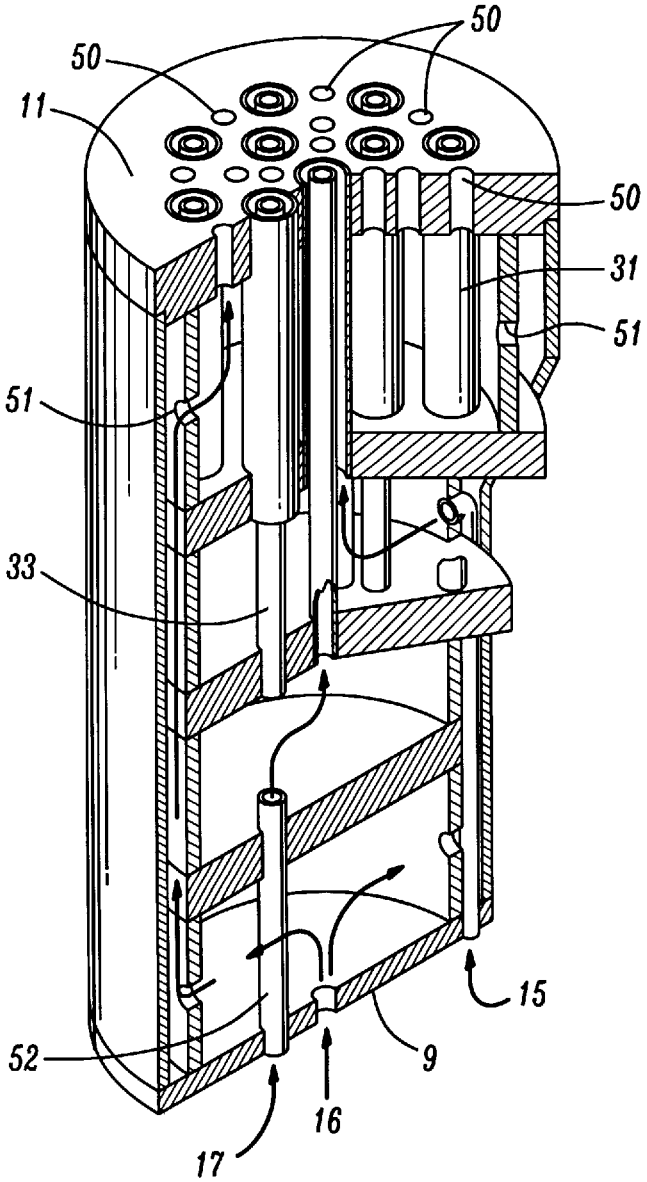
FIG. 6 is a top left isometric view of an alternate embodiment of the present invention.

FIG. 6 shows an alternate embodiment of the present invention with the same number of internal gas chambers and supply ports at the base plate and with concentric flow of fuel gases similarly delivered to the face of the burner, but in this embodiment the oxygen from the uppermost chamber is fed to the burner face through individual ports 50 which are dispersed throughout the burner face 11. As in the embodiment shown in FIG. 1, a supply of fuel gas 16 enters the center of the base of the burner body and is distributed along the inside of the burner body wall, but in this instance it is fed back toward the center of the body through ports 51, which feed the uppermost chamber through ports in the chamber ring 19. As in the embodiment shown in FIG. 1, a separately regulated supply of oxygen 17 is delivered to innermost conduit means 33 which are surrounded by tubes 31 which, in combination, carry the laminar flow of fuel gases to the burner face. Referring now to FIG. 7, it can also be seen that when comparing this embodiment to FIG. 2, the gases are delivered to the burner face over a wider area. Although the embodiment in FIG. 6 does not show the valving which was diagrammatically depicted in FIG. 1, it should readily be understood by those of ordinary skill in the art that each flow of fuel gases must be controlled by individual valving before it enters base plate 9. It should be further understood that the gases need not be comprised of oxygen and a second fuel gas, but may be any combination of three combustible gases from, for example, the group of hydrogen, oxygen, natural gas, propane, or another appropriate combustion gas. In the case of using three different combustion gases, of course, the manifold 14*a* shown in FIG. 1 is unnecessary.

Figure 9:
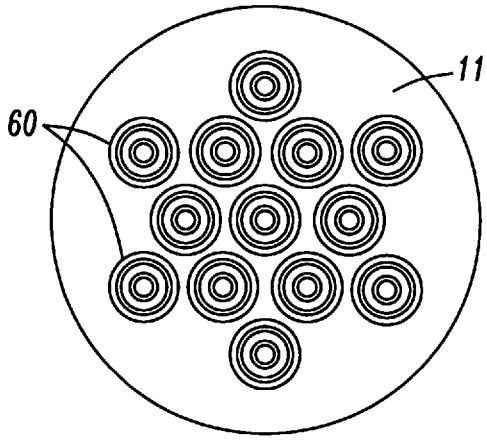
FIG. 9 is a top plan view of the embodiment shown in FIG. 8.
Figure 8:
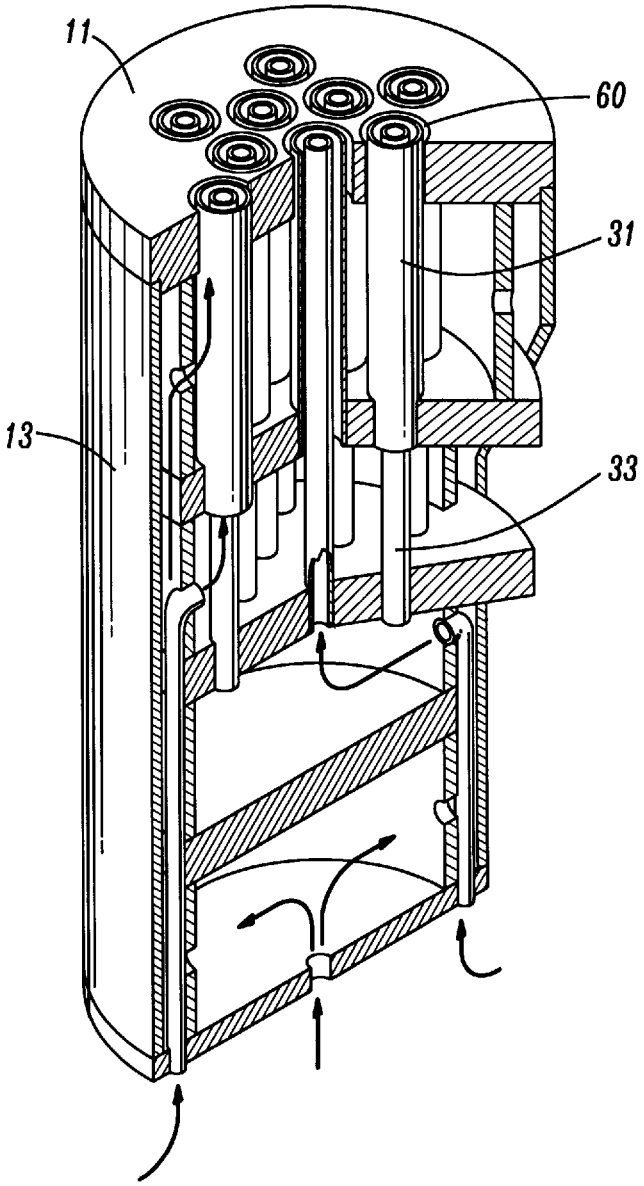
FIG. 8 is a top left cutaway view of an alternate embodiment of the present invention.

Referring now to FIGS. 8 and 9, yet another embodiment of the present invention is shown in which a cluster of tubes emanating from chambers similar to those formed in the embodiment shown in FIG. 3 feed gas to the burner face. However, in this embodiment, the tri-laminar flow of gases is strictly concentric with circular ports 60 surrounding circular tubes 31 and 33. As shown in FIG. 6, the triaxial ports are delivered to the burner as a multiplicity of jets evenly distributed throughout the burner face.

An important characteristic of all of these embodiments is that each of the three gas flows is independently regulated and that one surrounds the other in a tri-laminar flow. While this laminar orientation has been described as being oxygen/fuel gas/oxygen in the first preferred embodiment, it is important to also note that any combination of gases may be used in the embodiments shown in FIGS. 6 and 8. By adjusting the individual valves for each of the three gas streams, the flame can be "tuned" to provide various combinations of desired flame geometry and dynamics. This flexibility permits the same burner to be used in a wide variety of applications. Another important characteristic is that one of the oxygen streams is fed substantially along the entire surface of a thin-walled burner body. This is an important characteristic of the present invention because it functions to cool the burner body while simultaneously preheating the outermost flow of gas which surrounds the other jets. It is believed that this enhances combustion efficiency. A cool-running burner also provides the advantages previously described.

The present burner can be constructed by the assemblage of soldering individual parts. As shown in the preferred embodiments, the individual chambers are formed by stacking cylindrical rings separated by disks fitted into a cylinder which forms the side wall of the burner. The disks may be formed by removing material around the circumference of planar circular plates. Individual tubing is then extended through and around the disks as desired. Thus, the various chambers and ports are formed with a minimum of precise machining. It is an important part of the present invention to provide a burner construction which is extremely economical. It will also be understood that this permits the burner body to be formed from a section of thin-walled tubing which has the advantage of providing more efficient heat transfer which, in turn, yields an extremely cool-running burner with the various attendant advantages described above.

It should be understood that the above description discloses specific embodiments of the present invention and are for purposes of illustration only. There may be other modifications and changes obvious to those of ordinary skill in the art that fall within the scope of the present invention which should be limited only by the following claims and their equivalents.

What is claimed is:

1. A gas burner, comprising:

a hollow burner body, comprising side outer walls, a base plate at the bottom, and a burner face at the top;

separate sources of individually regulated oxygen and a fuel gas in fluid communication with entrance ports located in said base plate, comprising:

first valve means located on a first delivery line between said fuel gas source and a first entrance port for regulating the flow thereof;

a manifold for dividing said oxygen source into two streams;

second valve means located on a second delivery line carrying one of said two streams between said manifold and a second entrance port in said base plate;

third valve means located on a third delivery line carrying the other of said two streams of oxygen between said manifold and a third entrance port in said base plate;

means forming a first chamber within said body located directly above said base plate and in fluid communication with said second entrance port, said first chamber having exit ports including means in exclusive fluid communication with a first group of ports in said burner face;

means forming a second chamber directly above said first chamber including means in exclusive fluid communication with said third entrance port, said second chamber further including exit ports including means in fluid communication with a second group of ports in said burner face; and, means forming a third chamber located directly above said second chamber including means in exclusive fluid communication with said first entrance port, said third chamber further including including means exit ports in exclusive fluid communication with a third group of ports in said burner face.

2. The burner of claim 1, wherein said first and third groups of ports comprise a plurality of individual jets in said burner face, each jet having coaxial ports including a center port and a second surrounding port, said center ports being of said second group of ports and said surrounding ports being of said third group of ports.

3. The burner of claim 2, wherein said first group of ports are separate from and dispersed evenly between said jets in said burner face.

4. The burner of claim 2, wherein said first group of ports are coaxial with each of said jets, providing a second surrounding port for each jet whereby each jet delivers a tri-laminar flow of mixed gases to the area directly above said burner face.

5. The burner of claim 4, wherein all of the ports in a burner face are circular.

6. A gas burner, comprising:

a hollow burner body, comprising side outer walls, a base plate at the bottom, and a burner face at the top;

separate sources of individually regulated oxygen and a fuel gas in fluid communication with entrance ports located in said base plate, comprising:

first valve means located on a first delivery line between said fuel gas source and a first entrance port for regulating the flow thereof;

a manifold for dividing said oxygen source into two streams;

second valve means located on a second delivery line carrying one of said two streams between said manifold and a second entrance port in said base plate;

third valve means located on a third delivery line carrying the other of said two streams of oxygen between said manifold and a third entrance port in said base plate;

means forming a first chamber within said body located directly above said base plate and in fluid communication with said second entrance port, said first chamber having exit ports having means in exclusive fluid communication with a first group of ports in said burner face;

means forming a second chamber directly above said first chamber including means in exclusive fluid communication with said third entrance port, said second chamber further including including means exit ports in fluid communication with a single large port in said burner face which surrounds all other ports in said burner face; and, means forming a third chamber located directly above said second chamber including means in exclusive fluid communication with said first entrance port, said third chamber further including exit ports including means in exclusive fluid communication with a third group of ports in said burner face.

7. The burner of claim 6, wherein the top surface of said third chamber is the inside surface of said burner face.

8. The burner of claim 7, wherein a fluid path between said first chamber and the burner face ports is bounded by substantially the entire inside surface of said outer walls of said body.

9. The burner of claim 8, wherein said fluid path is defined by a vertically-extending jacket which surrounds all of said chambers.

10. The burner of claim 9, wherein said first, second and third chambers have side walls formed by individual cylindrical rings located between lateral separator disks.

11. The burner of claim 10, wherein said body is cylindrical, thin-walled tubing.

12. The burner of claim 11, wherein said fuel gas is propane.

13. The burner of claim 1, wherein the fluid communication between said second chamber and said second entrance port is provided by tubing which passes through said first chamber.

14. The burner of claim 9, wherein the fluid communication between said second chamber and said second entrance port is provided by tubing which passes through said jacket.

15. The burner of claim 10, wherein said disks include portions which contact the inside surface of said side walls of said body.

16. The burner of claim 15, wherein said disks are formed by removing material around the circumference of planar circular plates.

17. The burner of claim 10, wherein said disks, said chamber rings, said tubing, and said burner body are attached to each other by soldering.

18. A gas burner, comprising:

a hollow burner body, comprising side outer walls, a base plate at the bottom, and a burner face at the top;

separate sources of individually regulated gases in fluid communication with entrance ports located in said base plate, comprising:

first valve means located on a first delivery line between first gas source and a first entrance port for regulating the flow thereof;

second valve means located on a second delivery line between a second gas source and a second entrance port in said base plate;

third valve means located on a third delivery line carrying a third source of gas between said third source and a third entrance port in said base plate;

means forming a first chamber within said body located directly above said base plate and including means in fluid communication with said second entrance port, said first chamber having exit ports including means in exclusive fluid communication with a first group of ports in said burner face;

means forming a second chamber directly above said first chamber including means in exclusive fluid communication with said third entrance port, said second chamber further including exit ports including means in fluid communication with a second group of ports in said burner face; and, means forming a third chamber located directly above said second chamber including means in exclusive fluid communication with said first entrance port, said third chamber further including exit ports including means in exclusive fluid communication with a third group of ports in said burner face.

19. The burner of claim 18, wherein said gases are from the group consisting of oxygen, hydrogen, propane, and natural gas in any combination thereof.

* * * * *